US010908538B2

(12) United States Patent
Okumura

(10) Patent No.: US 10,908,538 B2
(45) **Date of Patent: *Feb. 2, 2021**

(54) IMAGE FORMING APPARATUS

(71) Applicant: CANON KABUSHIKI KAISHA, Tokyo (JP)

(72) Inventor: Shohei Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/124,499

(22) Filed: Sep. 7, 2018

(65) Prior Publication Data

US 2019/0004456 A1 Jan. 3, 2019

Related U.S. Application Data

(62) Division of application No. 15/611,113, filed on Jun. 1, 2017, now Pat. No. 10,197,953.

(30) Foreign Application Priority Data

Jun. 6, 2016 (JP) ..... 2016-112907

(51) Int. Cl.
*G03G 15/16* (2006.01)
*G03G 15/10* (2006.01)

(52) U.S. Cl.
CPC ..... *G03G 15/1665* (2013.01); *G03G 15/104* (2013.01); *G03G 15/1605* (2013.01); *G03G 15/1675* (2013.01)

(58) Field of Classification Search
CPC ..... G03G 15/1665; G03G 15/1675; G03G 15/1625
See application file for complete search history.

(56) References Cited

U.S. PATENT DOCUMENTS 5,450,180 A 9/1995 Ohzeki et al.
5,646,717 A 7/1997 Hiroshima et al.
(Continued)

FOREIGN PATENT DOCUMENTS

CN 101840185 A 9/2010
CN 103034098 A 4/2013
(Continued)

OTHER PUBLICATIONS

Extended European Search Report dated Nov. 7, 2017, in European Patent Application No. 17172363.8.
(Continued)

*Primary Examiner* — Erika J Villaluna
(74) *Attorney, Agent, or Firm* — Venable LLP

(57) ABSTRACT

An image forming apparatus includes an image bearing member; a transfer member configured to form a transfer portion where the toner image is transferred from the image bearing member by being supplied with a transfer bias; a carrier liquid supplying portion configured to supply the carrier liquid to the transfer portion; a transfer bias voltage source capable of applying the transfer bias to the transfer portion; a detecting portion configured to detect at least one of a voltage and a current at the transfer portion; and a setting portion configured to set the transfer bias during non-image-formation on the basis of a detection result of the detecting portion when a setting bias is applied from the transfer member in a state in which the carrier liquid is in the transfer portion.

6 Claims, 5 Drawing Sheets

(56) References Cited

U.S. PATENT DOCUMENTS

| | | | | |
|---|---|---|---|---|
| 5,774,774 | A * | 6/1998 | Tamura | G03G 15/1625 399/302 |
| 7,003,236 | B2 | 2/2006 | Fujita et al. | |
| 7,403,727 | B2 * | 7/2008 | Fujimori | G03G 15/5058 399/26 |
| 8,023,840 | B2 | 9/2011 | Shirafuji | |
| 8,346,113 | B2 | 1/2013 | Shibuya et al. | |
| 8,369,729 | B2 | 2/2013 | Torimaru | |
| 9,031,432 | B2 | 5/2015 | Shirodai et al. | |
| 9,996,038 | B2 | 6/2018 | Okumura | |
| 2006/0120749 | A1 | 6/2006 | Ahn | |
| 2009/0092418 | A1 | 4/2009 | Toyama | |
| 2010/0322652 | A1 | 12/2010 | Torimaru | |
| 2013/0084090 | A1 | 4/2013 | Shirodai et al. | |
| 2013/0330096 | A1 | 12/2013 | Mochizuki | |

FOREIGN PATENT DOCUMENTS

| | | | |
|---|---|---|---|
| JP | 58-111960 | A | 7/1983 |
| JP | 02-123385 | A | 5/1990 |
| JP | 05-6112 | A | 1/1993 |
| JP | 08-76595 | A | 3/1993 |
| JP | 2002-062714 | A | 2/2002 |
| JP | 2004-069860 | A | 3/2004 |
| JP | 2004-145189 | A | 5/2004 |
| JP | 2005-315944 | A | 11/2005 |
| JP | 2009-063678 | A | 3/2009 |
| JP | 2009-109976 | A | 5/2009 |
| JP | 2011-095557 | A | 5/2011 |
| JP | 2013-080115 | A | 5/2013 |

OTHER PUBLICATIONS office Action dated Jul. 3, 2019, in Chinese Patent Application No. 201710403958.9.

Office Action dated Mar. 17, 2020, in Japanese Patent Application No. 2016-112907.

Office Action dated Mar. 27, 2020, in Korean Patent Application No. 10-2017-0069476.

Office Action dated Apr. 2, 2020, in Chinese Patent Application No. 201710403958.9.

Office Action dated Oct. 26, 2020, in Korean Patent Application No. 10-2017-0069476.

* cited by examiner (a)

(b)

IMAGE FORMING APPARATUS

FIELD OF THE INVENTION AND RELATED ART

The present invention relates to an image forming apparatus, of an electrophotographic type, an electrostatic recording type or the like, in which a liquid developer is used, and particularly relates to transfer of a toner image on an image bearing member.

Conventionally, the image forming apparatus of the electrophotographic type has been widely used as a copying machine, a printer, a plotter, a facsimile machine, a multifunction machine having a plurality of functions of these machines, or the like. As the image forming apparatus of the electrophotographic type, an image forming apparatus having a constitution in which an image formed on an image bearing member such as a photosensitive drum with a coloring agent such as toner is electrostatically transferred onto a transfer-receiving material such as a recording material or an intermediary transfer member by applying a transfer portion has been known.

In the electrostatic transfer of this type, due to excess and deficiency of electric charges supplied from a transfer means to the transfer-receiving material at the transfer portion, a lowering in transfer efficiency and improper transfer generates in some cases. Such excess and deficiency of the electric charges can be generated by a fluctuation in resistance value of the transfer means, the toner, a carrier or the like, for example. Examples of a transfer roller and the intermediary transfer member which are used as the transfer means include those in which an electroconductive agent is dispersed and thus the resistance value is appropriately adjusted, but in which the resistance value can be fluctuated due to various factors such as a difference among individuals during manufacturing, a change in temperature and humidity, continuous energization, and a fluctuation in durability. Further, as regards the toner and the carrier, a resistance value is fluctuated due to a disturbance factor, an energization image ratio, a consumption amount or the like in some cases.

Therefore, a technique in which in order to supply a desired amount of electric charges to the transfer portion by correcting an influence due to the fluctuations in these resistance values, transfer bias setting control for setting a proper transfer bias is executed at timing other than during image formation has been known. As the transfer bias setting control, for example, ATVC (active transfer voltage control) and PTVC (programmable transfer voltage control) have been well known.

In Japanese Laid-Open Patent Application (JP-A) Hei 02-123385, a constant current corresponding to a current value necessary to transfer a toner image during image formation is supplied to a transfer portion at timing other than during image formation, and on the basis of an output voltage detected at this time, a transfer bias during image formation is set (ATVC). In JP-A Hei 05-6112, currents flowing through a transfer portion during constant-voltage application is detected for a plurality of voltage levels at timing other than during image formation, and on the basis of an interpolation calculation result of these voltage-current data, a transfer bias during image formation is set (PTVC).

Incidentally, in the above-described transfer bias setting control, as a developer, a dry developer using toner in a dry state is used. Further, for example, the resistance value of the transfer portion is substantially constant between timing, other than during image formation, such as during non-sheet-passing, and during image formation, and therefore, even when the transfer bias set at the timing other than during image formation is applied during image formation, it is possible to realize transfer with no excess and deficiency of the electric charges.

However, in the above-described image forming apparatuses, the dry developer is used as the developer, and therefore, in the case where the image forming apparatuses are applied to an image forming apparatus which has been developed in recent years and which uses a liquid developer, there is a possibility that the following problem generates.

That is, in the image forming apparatus using the liquid developer containing toner particles and a carrier liquid, the carrier liquid does not exist at a transfer portion at timing other than during image formation, but exists at the transfer portion during image formation. A resistance value of the transfer portion changes depending on whether or not the carrier liquid exists at the transfer portion, so that a current flowing through the transfer portion fluctuates. For this reason, even when the transfer bias set in a state in which the carrier liquid does not exist at the timing other than during image formation is applied to a state in which the carrier liquid exists during image formation, the transfer bias deviates from a desired transfer bias, so that there is a liability that the transfer with no excess and deficiency of the electric charges cannot be realized.

SUMMARY OF THE INVENTION

According to an aspect of the present invention, there is provided an image forming apparatus comprising: an image bearing member movable while bearing a toner image formed using a liquid developer containing toner and a carrier liquid; a transfer member configured to form a transfer portion where the toner image is transferred from the image bearing member by being supplied with a transfer bias; a carrier liquid supplying portion configured to supply the carrier liquid to the transfer portion; a transfer bias voltage source capable of applying the transfer bias to the transfer portion; a detecting portion configured to detect at least one of a voltage and a current at the transfer portion; and a setting portion configured to set the transfer bias during non-image-formation on the basis of a detection result of the detecting portion when a setting bias is applied from the transfer member in a state in which the carrier liquid is in the transfer portion.

Further features of the present invention will become apparent from the following description of exemplary embodiments with reference to the attached drawings.

DESCRIPTION OF EMBODIMENTS

In the following, an embodiment of the present invention will be described with reference to FIGS. 1-4. An image forming apparatus 1 in this embodiment is a digital printer of an electrophotographic type in which a toner image formed with a liquid developer containing toner and a carrier liquid is formed (transferred) on a recording material.

Figure 1:
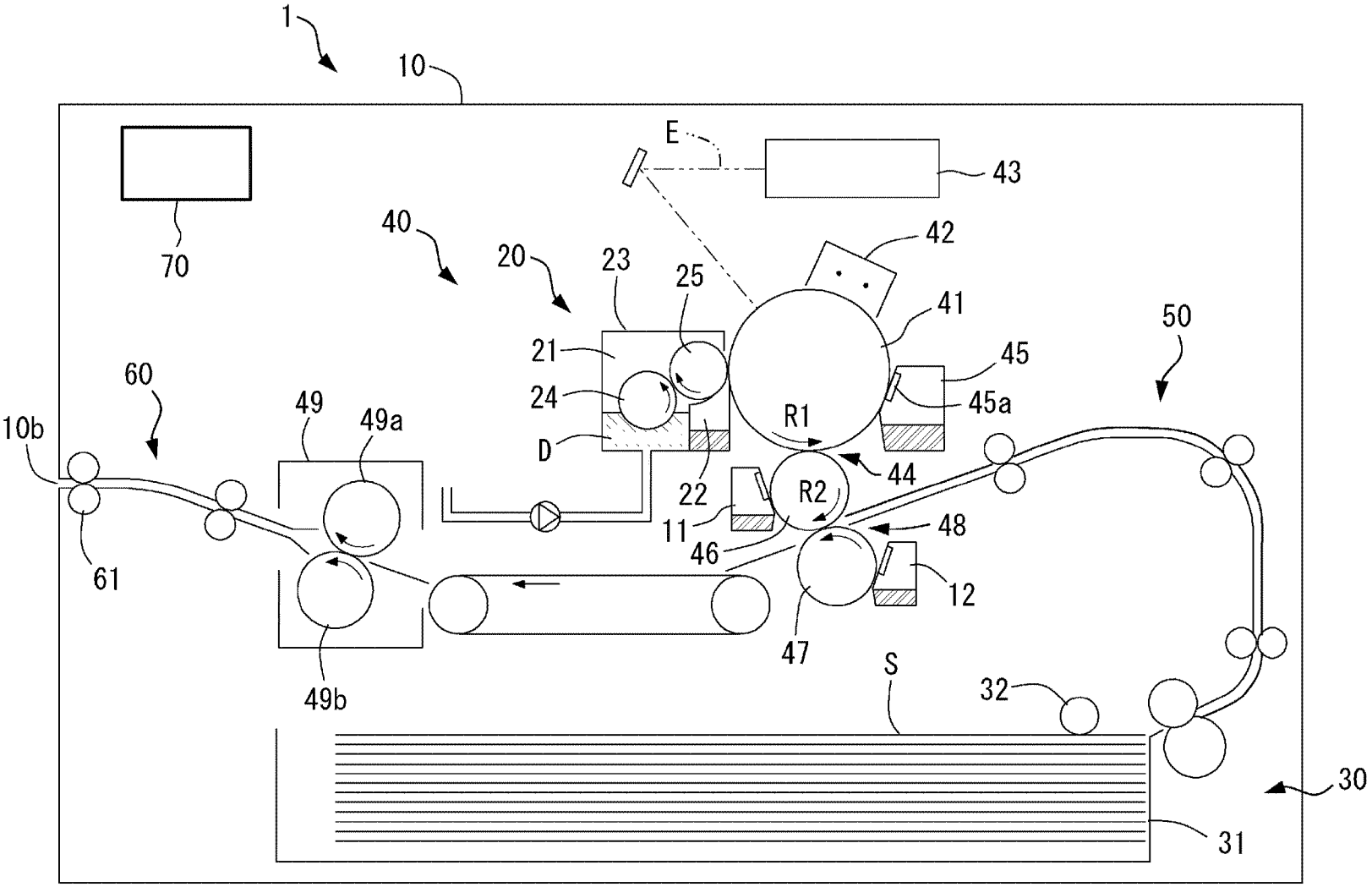
FIG. 1 is a schematic sectional view of an image forming apparatus according to an embodiment of the present invention.

As shown in FIG. 1, the image forming apparatus 1 includes an image forming apparatus main assembly 10. The apparatus main assembly 10 includes a sheet feeding portion 30, an image forming portion 40, a sheet conveying portion 50, a sheet discharging portion 60, and a controller 70. Incidentally, on a sheet S which is a recording material, the toner image is to be formed, and specific examples of the sheet S include plain paper, a resin (material) sheet which is a substitute for the plain paper, thick paper, a sheet for an overhead projector, and the like.

The image forming apparatus 1 operates on the basis of an image signal, and transfers the toner image formed by the image forming portion 40 onto the sheet S as the recording material is successively fed (conveyed) from a sheet cassette 31, and thereafter the toner image is fixed on the sheet S and thus an image is obtained. The image signal is sent to the image forming apparatus 1 from an unshown external terminal such as a scanner or a personal computer.

The sheet feeding portion 30 is disposed at a lower portion of the apparatus main assembly 10 and includes the sheet cassette 31 for stacking and accommodating sheets such as recording paper and includes a feeding roller 32, and feeds the accommodated sheet S to the image forming portion 40.

The image forming portion 40 includes a photosensitive drum (image bearing member) 41, a charger (charging means) 42, a laser exposure device 43, a developing device (carrier liquid supplying portion) 20, a drum cleaner 45, an intermediary transfer drum (transfer means) 46, a secondary transfer roller 47 and a fixing device 49.

The photosensitive drum 41 is a drum-shaped electrophotographic photosensitive member, and is rotated in an arrow R1 direction in FIG. 1 by an unshown drum motor, so that the photosensitive drum 41 is circulated and moved while carrying an electrostatic latent image formed on the basis of image information during image formation. The photosensitive drum 41 is movable while carrying the toner image formed with the liquid developer.

The charger 42 is disposed in substantially parallel to a center axis of the photosensitive drum 41 and electrically charges uniformly a surface of the photosensitive drum 41 to a predetermined potential of the same polarity as a charge polarity of the toner (hereinafter, this potential is referred to as a dark-portion potential Vd). That is, the charger 42 charges the photosensitive drum 41 by a charging bias. In this embodiment, as the toner, a negatively chargeable toner is used, and therefore, the dark-portion potential Vd has a negative value. Further, as the charger 42, a corona charger is used. However, the charger 42 is not limited to the corona charger, but a charging roller or the like may also be used as the charger 42.

The laser exposure device 43 exposes the surface of the photosensitive drum 41 charged to the dark-portion potential to laser light E emitted in a side downstream of the charger 42 with respect to the R1 direction and thus causes potential drop at an exposure portion, so that the electrostatic latent image is formed on the surface of the photosensitive drum 41. The potential at the exposure portion when the voltage drop is caused at the exposure portion is a light-portion potential Vl. In this embodiment, the laser exposure device 43 emits the laser light E modulated depending on an image signal of an original, so that the emitted laser light E is projected on the surface of the photosensitive drum 41 via an unshown polygon mirror, an unshown f-θ lens and the like.

The developing device 20 includes a developing container 23 divided into a supplying section 21 and a collecting section 22. Into the supplying section 21, a liquid developer D is supplied from a mixer, and a controller 24 and a developing roller (developing means) 25 are accommodated in the supplying section 21. The developing device 20 is disposed downstream of the laser exposure device 43 with respect to the R1 direction, and is provided so as to be movable toward and away from the photosensitive drum 41. In a contact state between the developing device 20 and the photosensitive drum 41, the developing roller 25 contacts the photosensitive drum 41 with a predetermined pressure, so that a developing portion is formed. Incidentally, in this embodiment, the liquid developer D is a liquid material in which powdery toner as a dispersoid is dispersed in the carrier liquid as a dispersion medium.

The controller 24 is in an immersed state in the liquid developer D stored in the supplying section 21, and is provided rotatably in contact with the developing roller 25. Together with rotation of the controller 24, by applying a voltage at a contact portion with the developing roller 25, the developing roller 25 is coated with the liquid developer D.

The developing roller 25 is constituted by a metal shaft and an elastic layer formed with an electroconductive rubber around the metal shaft, and is rotationally driven by an unshown driving means so that a surface speed thereof is substantially equal to a surface speed of the photosensitive drum 41 at the developing portion. On the surface of the developing roller 25, the liquid developer D which is supplied from an unshown developer tank (container) via unshown means such as an adjusting means, a stirring means, a conveying means and a regulating means and which has a predetermined developer density and a predetermined amount is carried. Here, the developer density is a weight ratio of the toner to the liquid developer D (hereinafter, referred to as T/D). By the rotation of the developing roller 25, the liquid developer D is supplied to the developer D.

A predetermined developing bias Vdev is applied to the metal shaft of the developing roller 25, whereby the electrostatic latent image on the photosensitive drum 41 is developed, so that the toner image is formed on the photosensitive drum 41. Specifically, only the carrier liquid is deposited on a portion of the photosensitive drum 41 where the surface potential is Vd, and both of the toner and the carrier liquid are deposited on a portion of the photosensitive drum 41 where the surface potential is Vl. The carrier liquid and the toner which remain on the developing roller 25 are collected into the collecting section 22 of the developing device 20. That is, the developing device 20 includes the developing roller 25, capable of supplying the liquid developer D to the photosensitive drum 41 by being supplied with the developing bias, for developing the electrostatic latent image formed on the photosensitive drum 41 into the toner image with the toner.

The intermediary transfer drum 46 is disposed downstream of the developing device 20 with respect to the R1 direction and is movable toward and away from the photosensitive drum 41. In a contact state between the intermediary transfer drum 46 and the photosensitive drum 41, the intermediary transfer drum 46 is contacted to the photosensitive drum 41 with a predetermined pressure, so that a primary transfer portion (transfer portion) 44 is formed.

Figure 2:
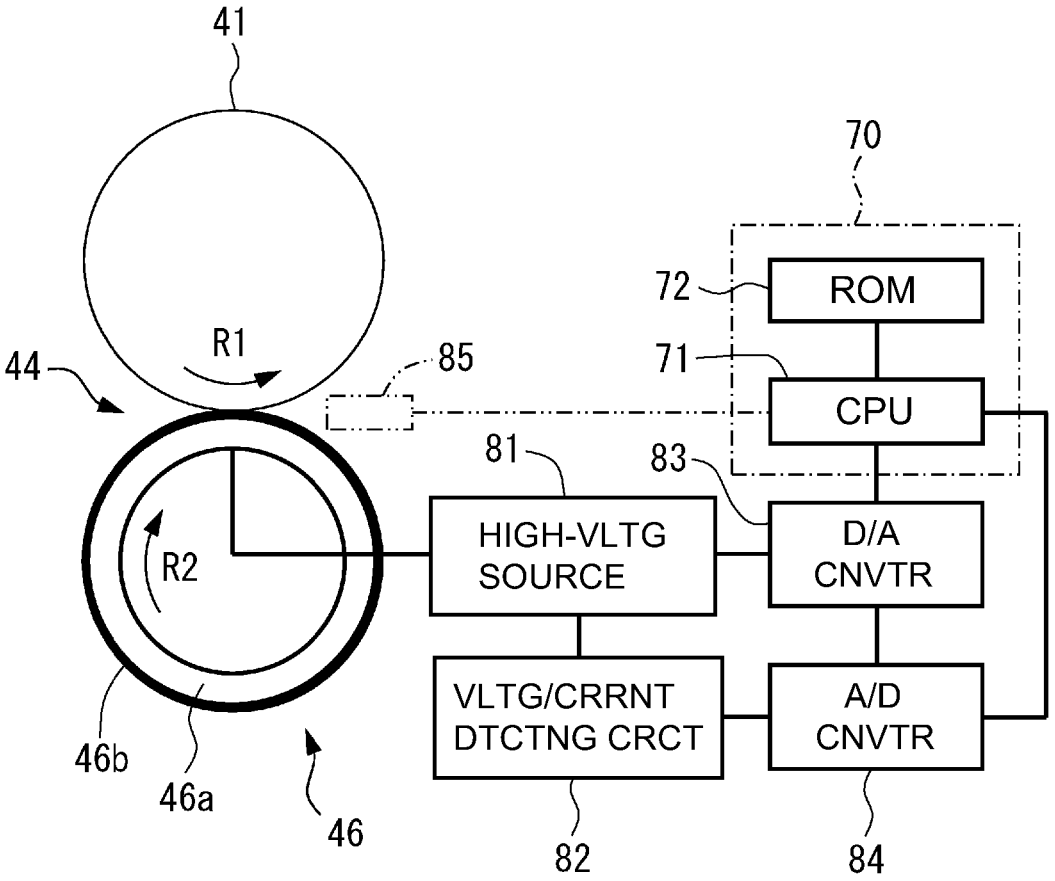
FIG. 2 is a schematic block diagram showing an electric circuit for applying a primary transfer bias of the image forming apparatus in the embodiment.

As shown in FIG. 2, the intermediary transfer drum 46 includes a drum-shaped metal support 46*a* and an intermediary transfer member 46*b* formed at a periphery of the support 46*a*. The intermediary transfer drum 46 is rotationally driven in an R2 direction by an unshown driving means so that a surface speed thereof is substantially equal to the surface speed of the photosensitive drum 41 at the primary transfer portion 44.

The intermediary transfer member 46*b* includes an elastic layer formed of an electroconductive rubber and a surface layer. In this embodiment, the elastic layer of $1.0\times10^{7}$-$1.0\times10^{11}$ Ω·cm in volume resistivity, 30-40 degrees in JP-A hardness and 2 mm in thickness was used, but an elastic layer having different values may also be used. The surface layer may desirably have good wettability with the liquid developer D, and the surface layer of not more than 40° in contact angle with the carrier liquid was used. Further, in this embodiment, as materials of the elastic layer and the surface layer, a urethane-based material adjusted in resistivity and surface property was used, but the present invention is not limited thereto. For example, when degrees of influences of elution into the liquid developer D, swelling due to the liquid developer D, another deterioration, and the like are small, other materials and other layer structures may also be used.

Here, the apparatus main assembly 10 includes a high-voltage source (transfer voltage source) 81 and a voltage and current detecting circuit (detecting portion) 82. The high-voltage source 81 is connected with a controller 70 via a D/A converter 83, for example, and constant-current control and constant-voltage control are executable by the controller 70, so that a transfer bias is applicable to the primary transfer portion 44. The voltage and current detecting circuit 82 is connected with the controller 70 via an A/D converter 84, for example, and detects at least one of the voltage and the current at the primary transfer portion 44 by detecting an output voltage and an output current.

The metal support 46*a* of the intermediary transfer drum 46 is connected with the high-voltage source (transfer voltage source) 81. From the high-voltage source 81 to the metal support 46*a*, a primary transfer bias of an opposite polarity (i.e., positive polarity) to the charge polarity of the toner is applied, whereby an electric field for moving the negatively charged toner toward the intermediary transfer drum 46 at the primary transfer portion 44 is formed. As a result, the toner image on the photosensitive drum 41 is primary-transferred onto the intermediary transfer drum 46. That is, the intermediary transfer drum 46 forms the primary transfer portion 44, where the toner image is transferred from the photosensitive drum 41, by being supplied with the transfer bias. Further, the developing device 20 is capable of supplying the carrier liquid to the primary transfer portion 44 via the photosensitive drum 41. Incidentally, the intermediary transfer drum 46 is provided with an intermediary transfer roller (drum) cleaner 11 for collecting the remaining liquid developer D.

A drum cleaner 45 is provided downstream of the intermediary transfer drum 46 with respect to the R1 direction and includes a cleaning blade 45*a*. The cleaning blade 45*a* is contacted to the photosensitive drum 41 with a predetermined angle and a predetermined pressure by an unshown pressing means, so that the liquid developer D remaining on the photosensitive drum 41 is scraped off by the cleaning blade 45*a* and prepares for a subsequent process.

As shown in FIG. 1, the secondary transfer roller 47 is disposed downstream of the primary transfer portion 44 with respect to the R2 direction and is provided so as to be movable toward and away from the intermediary transfer drum 46. In a contact state between the secondary transfer roller 47 and the intermediary transfer drum 46, the secondary transfer roller 47 contacts the intermediary transfer drum 46 with a predetermined pressure, so that a secondary transfer portion 48 is formed. The secondary transfer roller 47 is rotationally driven by an unshown driving means so that a surface speed thereof is substantially equal to the surface speed of the intermediary transfer drum 46 at the secondary transfer portion 48. Further, the secondary transfer roller 47 is connected with an unshown voltage source, and a secondary transfer bias is applicable to the secondary transfer roller 47. Incidentally, the secondary transfer roller 47 is provided with a transfer roller cleaner 12 for collecting the remaining liquid developer D.

The fixing device 49 includes a fixing roller 49*a* and a pressing roller 49*b*. The sheet S is nipped and fed between the fixing roller 49*a* and the pressing roller 49*b*, whereby the toner image transferred on the sheet S is heated and pressed and is fixed on the sheet S. The sheet discharging portion 60 includes a discharging roller pair 61 provided in a side downstream of the fixing device 49. The sheet S fed from the discharging roller pair 61 is discharged through a discharge opening 10*b* formed in the apparatus main assembly 10.

Here, in this embodiment, the liquid developer D is a liquid developer including pigment-containing resin particles (toner) and a non-volatile liquid solvent (carrier liquid), and the toner is dispersed together with a dispersant, a charge control agent and the like in the carrier liquid. An average toner particle size of the toner is 1 μm, and a T/D ratio in the developer tank is 2-15%. The toner is $1.0\times10^{10}$-$1.0\times10^{12}$ Ω·cm in volume resistivity and is 1-100 mPa·s in viscosity. Further, the T/D ratio of the liquid developer D changes every process of the development, the primary transfer and the secondary transfer, and also the volume resistivity and the viscosity fluctuate correspondingly.

As shown in FIG. 2, the controller 70 is constituted by a computer and includes, for example, a CPU 71, a ROM 72 for storing a program for controlling the respective portions, an unshown RAM for temporarily storing data, and an unshown input/output circuit through which signals are inputted from and outputted into an external device. The ROM 72 is a non-volatile memory and stores, for example, a target transfer current value $I_1$, as a target value of a transfer current, calculated in advance and capable of providing an optimum primary transfer.

The controller 70 is connected with the sheet feeding portion 30, the image forming portion 40, the sheet conveying portion 50 and the sheet discharging portion 60 via the input/output circuit and not only transfers signals with the respective portions but also controls operations of the respective portions. During non-image-formation, in a state in which the carrier liquid is supplied to the primary transfer portion 44, the controller 70 sets a transfer bias on the basis of a detection result of the voltage and current detecting circuit 82 when a setting bias is applied from the intermediary transfer drum 46.

Here, during image formation is a time when the toner image is formed on the photosensitive drum 41 on the basis of image information inputted from an external terminal, such as a scanner or a personal computer, provided to the image forming apparatus 1. Further, during non-image-formation is a time other than during image formation and, for example, before and after execution of an image forming job after main switch actuation, and pre-rotation, a sheet interval, post-rotation and the like during the image forming job. Incidentally, the image forming job is a series of the following operations carried out on the basis of a print instruction signal (image formation instruction signal). That is, the image forming job is a series of operations from a start of a preparatory operation (pre-rotation) required for carrying out the image formation until an image forming step is performed and then a preparatory operation (post-rotation) required for ending the image formation is completed. The sheet interval is a period corresponding to an interval, in which in the case where the image formation is continuously carried out, between a toner image formed on one sheet and a toner image formed on subsequent one sheet.

In this embodiment, the controller 70 supplies the liquid developer to the photosensitive drum 41 by the developing roller 25 supplied with the developing bias after a leading end of the charging region of the photosensitive drum 41 charged with the charging bias passes through the developing portion. Subsequently, the controller 70 applies the setting bias after a liquid developer deposition region of the photosensitive drum 41 passes through the primary transfer portion 44. Further, in this embodiment, the controller 70 can set the transfer bias during pre-rotation in the image forming job.

Next, the image forming operation of the image forming apparatus 1 constituted as described above will be described.

When an image forming job signal is inputted into the controller 70, various adjustments are carried out in the pre-rotation operation. When the pre-rotation operation is started, the photosensitive drum 41 is rotated and the surface thereof is electrically charged by the charger 42. Then, on the basis of the image information, the laser light is emitted from the laser exposure device 43 to the photosensitive drum 41, so that the electrostatic latent image is formed on the surface of the photosensitive drum 41. The toner is deposited on this electrostatic latent image, whereby the electrostatic latent image is developed and visualized as the toner image and then the toner image is primary-transferred onto the intermediary transfer drum 46.

On the other hand, the feeding roller 32 rotates in parallel to such a toner image forming operation and feeds an uppermost sheet S on the sheet cassette 31 while separating the sheet S. Then, the sheet S is conveyed to the secondary transfer portion 48 by being timed to the toner image on the intermediary transfer drum 46. The sheet S supplied to the secondary transfer portion 48 is nipped and conveyed by the intermediary transfer drum 46 and the secondary transfer roller 47. The secondary transfer bias has the positive polarity and is larger in absolute value than the primary transfer bias, and therefore, an electric field for moving the negative toner from the intermediary transfer drum 46 toward the sheet at the secondary transfer portion 48 is formed, so that the toner image is transferred from the intermediary transfer drum 46 onto the sheet S. The sheet S on which the toner image at the secondary transfer portion 48 is transferred is conveyed to the fixing device 49, in which the unfixed toner image is heated and pressed and thus is fixed on the surface of the sheet S, and then the sheet S is discharged through the discharge opening 10*b* by the discharging roller pair 61. After the image forming operation, the controller 70 executes various adjustment and ending operations by the post-rotation operation.

Figure 3:
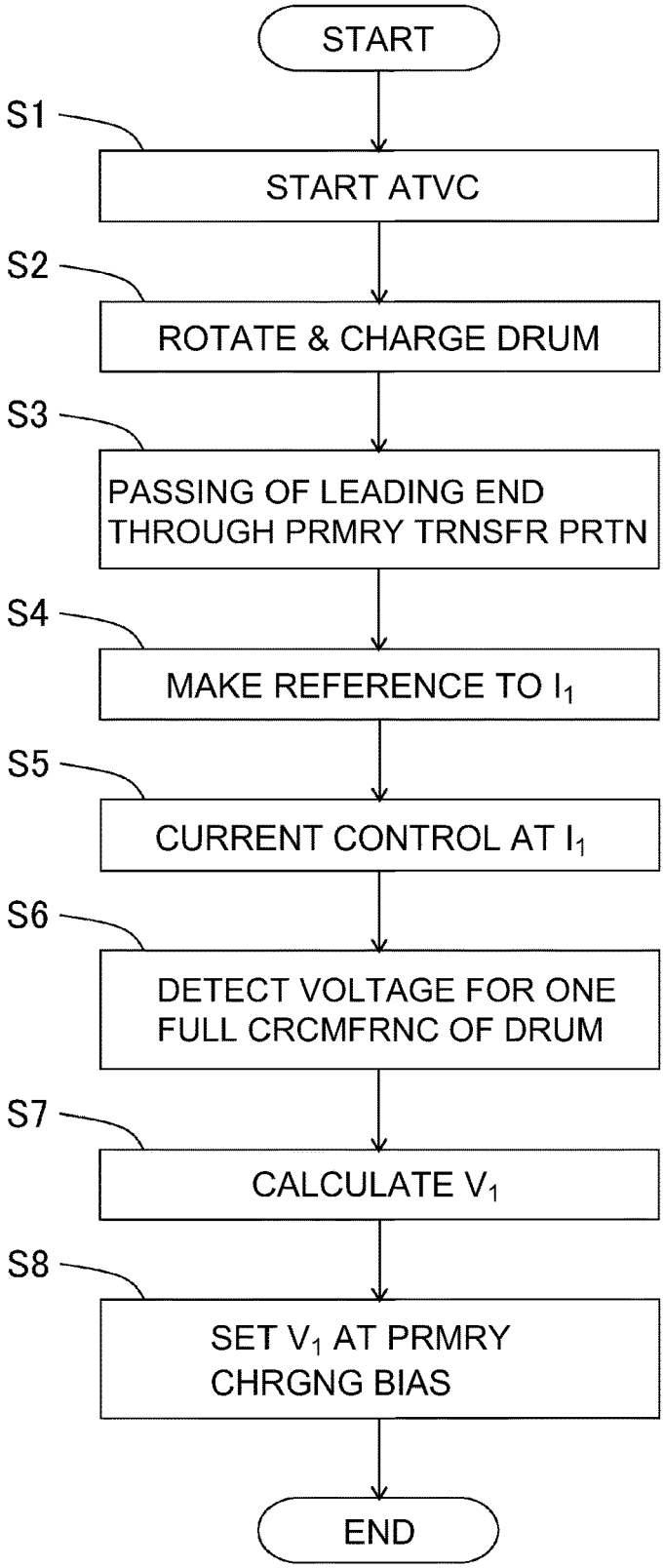
FIG. 3 is a flowchart showing a process procedure of ATVC in the image forming apparatus in the embodiment.

Next, a procedure when the ATVC is carried out by the image forming apparatus 1 in this embodiment described above will be described along a flowchart shown in FIG. 3.

As regards the intermediary transfer drum 46, as a material, an electroconductive urethane material subjected to resistance adjustment was used, but it is difficult for such an intermediary transfer member to suppress a difference among individuals during manufacturing, and in addition, a resistance value changes due to a change in temperature and humidity in an ambient condition (environment), energization deterioration, a fluctuation in durability, and the like. This is true for also the toner and the carrier of the liquid developer D. In order to always carry out optimum transfer under such a resistance fluctuation (condition), in the image forming apparatus 1 of this embodiment, the ATVC is carried out. The controller 70 effects the ATVC on the basis of an ATVC execution signal. In this embodiment, the ATVC execution signal is generated with a predetermined sheet (print) number interval in the continuous printing during main switch actuation of the main assembly of the image forming apparatus 1 or during the pre-rotation of the image forming job. However, the ATVC execution signal may also be generated at timing other than these timings.

The controller 70 starts the ATVC on the basis of the ATVC execution signal at timing (during non-image-formation) other than during image formation (step S1).

The controller 70 causes the photosensitive drum 41 to rotate and then causes the charger 42 to charge the surface of the photosensitive drum 41 to the dark-portion potential Vd (step S2). After a leading end of the charging region of the photosensitive drum 41 passes through the primary transfer portion 44 (step S3), the controller 70 makes reference to the target transfer current value $I_1$ stored in the ROM 72 (step S4). In the charged state of the photosensitive drum 41, the controller 70 carries out constant current control of the target transfer current value $I_1$ by the high-voltage source 81 (step S5).

The controller 70 determines a value of the transfer bias during image formation on the basis of a voltage detected at this time by the voltage and current detecting circuit 82. There are various methods of determining the value of the transfer bias from the detected voltage, but in this embodiment, for example, an output voltage is detected when the constant current control is carried out for one full circumference of the intermediary transfer drum 46 (step S6), and an average $V_1$ of voltage values is used as the transfer bias (step S7). This average $V_1$ is set as the value of the transfer bias (step S8). The controller 70 applies the above-set transfer bias value through the constant current control during image formation.

Here, an IV characteristic in the primary transfer will be described. With regards to a current flowing through the primary transfer portion 44 in the case where the surface of the photosensitive drum 41 is charged to Vd=−600 V and the primary transfer bias is applied to the intermediary transfer drum 46, the following two cases will be compared.

(1) Case that the developing roller 25 is spaced from the photosensitive drum 41

(2) Case that the developing roller 25 is contacted to the photosensitive drum 41 and the developing bias Vdev=−400 is applied to the developing roller 25

Figure 5:
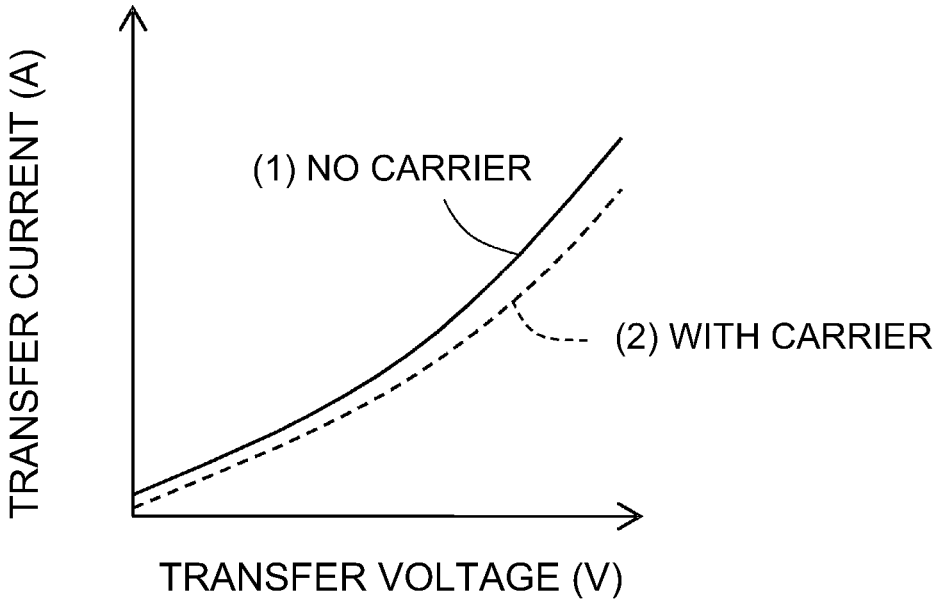
In FIG. 5, (a) is a graph showing an IV characteristic at the transfer portion, and (b) is a graph showing a relationship between a transfer current and a transfer efficiency.
Figure 5:
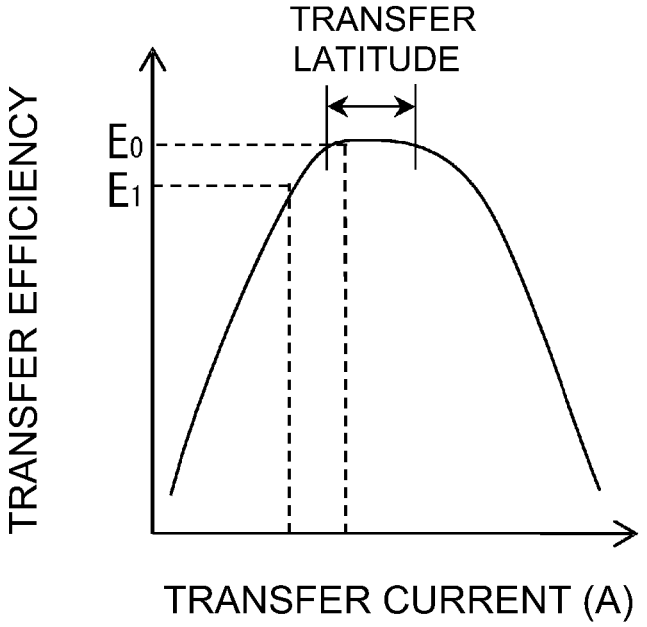

In the case (1), supply of the carrier liquid from the developing roller 25 to the photosensitive drum 41 is not carried out. On the other hand, in the case (2), the carrier liquid is supplied from the developing roller 25 to the photosensitive drum 41. At this time, when a current flowing through the primary transfer portion 44 is plotted in each of the respective cases (1) and (2) while changing the primary transfer bias, IV characteristic curves shown in (a) of FIG. 5 are obtained (solid line: Case (1), broken line: Case (2)).

When the surface potential of the photosensitive drum 41 is measured in each of the cases, in both of the cases (1) and (2), the surface potential immediately after the charging portion was 600 V. However, the surface potential of the photosensitive drum 41 between the developing portion and the primary transfer portion was 570 V for the case (1), but on the other hand, was 450 V for the case (2). That is, this means that in the case (1), the surface potential is subjected to dark decay from 600 V to 570 V between the charging portion to the primary transfer portion, but on the other hand, in the case (2), in addition to the dark decay between the charging portion and the developing portion, electric charge injection from the developing roller 25 into the photosensitive drum 41 was generated at the developing portion. As a result, in the case where a certain transfer bias is applied at the primary transfer portion, a potential difference between the photosensitive drum 41 and the intermediary transfer drum 46 is always smaller in the case (1) than in the case (2). For this reason, the IV characteristic curves at the primary transfer portion 44 are, as shown in (a) of FIG. 5, such that the curve of the case (2) is lower than the curve of the case (1).

As described above, the IV characteristic of the primary transfer is different depending on whether or not the carrier liquid supplied from the developing roller 25 to the photosensitive drum 41 exists at the primary transfer portion 44. The carrier liquid exists at the primary transfer portion 44 during image formation, and therefore, when transfer bias setting is made in a state in which the carrier liquid does not exist at the primary transfer portion 44, there is a possibility that a desired current value during image formation cannot be obtained due to the difference in IV characteristic.

In general, a transfer efficiency is the function of an amount of electric charges (transfer current) supplied to the transfer portion and shows a tendency as illustrated in (b) of FIG. 5. That is, a proper range (transfer latitude) in which a good transfer efficiency E0 can be obtained exists, so that the transfer efficiency decreases even in either case of insufficient electric charges and excessive electric charges. The good transfer efficiency E0 can be obtained when the transfer current falls within the transfer latitude, but in the case where energization deterioration of the member generates, it is desirable that the transfer current is set in a low side from the viewpoint of lifetime extension. However, when the current flowing through the transfer portion is deviated toward the low side, there is a possibility that the transfer efficiency becomes a transfer efficiency E1 lower than the transfer efficiency E0. Therefore, in the image forming apparatus 1 in this embodiment, in order to avoid such an inconvenience, the ATVC is carried out in the state in which the carrier liquid exists at the primary transfer portion 44.

Figure 4:
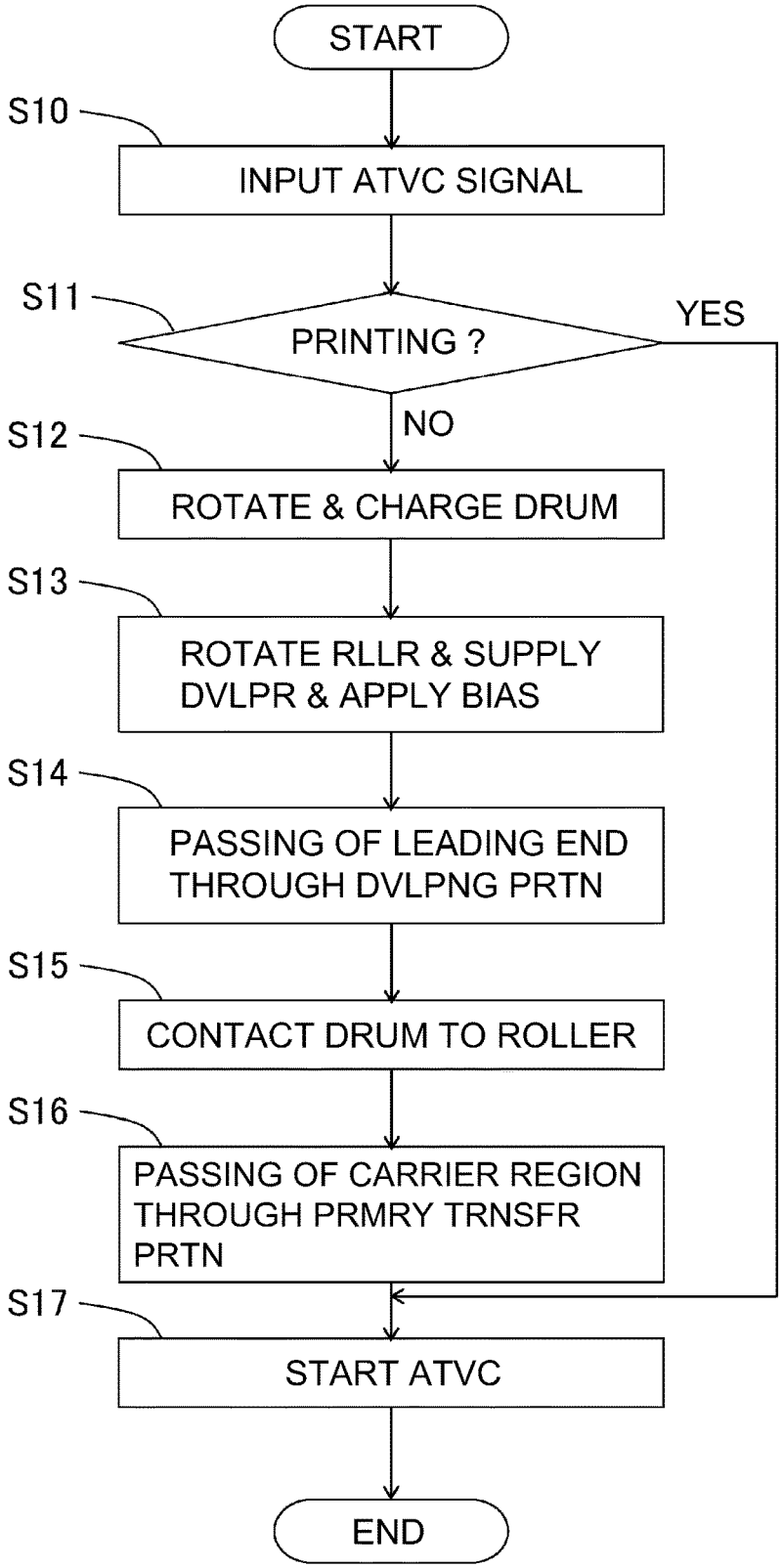
FIG. 4 is a flowchart showing an operation at a periphery of a primary transfer portion from an input of an ATVC execution signal until the ATVC is actually started in the image forming apparatus in the embodiment.

In the following, an operation at a periphery of the primary transfer portion 44 until the ATVC is started after the ATVC execution signal in the image forming apparatus 1 in this embodiment is inputted will be described along a flowchart shown in FIG. 4.

When the ATVC execution signal is inputted (step S10), the controller 70 discriminates whether or not the image forming job is during continuous image forming job (step S11). In the case where the controller 70 discriminated that the image forming job is during continuous image forming job, the carrier liquid has already been supplied to the primary transfer portion 44, and therefore, the ATVC is effected as it is (step S17).

In the case where the controller 70 discriminated that the image forming job is not during the continuous image forming job, the operation is during main switch actuation of the main assembly of the image forming apparatus 1, during pre-rotation of the image forming job or the like and the controller 70 discriminates that a possibility of non-existence of the carrier liquid at the primary transfer portion 44 is high. For this reason, the controller 70 executes the ATVC after the carrier liquid is supplied to the primary transfer portion 44.

That is, the controller 70 causes the photosensitive drum 41 to rotate and causes the charger 42 to charge the surface of the photosensitive drum 41 to the dark-portion potential Vd (step S12), and then carries out rotational drive of the developing roller 25, supplying of the liquid developer D and developing bias application (step S13). After a leading end of the charging region on the photosensitive drum 41 passes through the developing portion by rotation of the photosensitive drum 41 (step S14), the controller 70 causes the developing roller 25 to contact the photosensitive drum 41 (step S15). The developing roller 25 carrying the liquid developer D on its surface contacts the photosensitive drum 41, having the surface potential which is the dark-portion potential Vd, in a state in which the developing bias is applied. As a result, only the carrier is deposited on the surface of the photosensitive drum 41 without movement of the toner from the developing roller 25 toward the photosensitive drum 41.

Subsequently, after a leading end of a deposited region of the carrier liquid on the photosensitive drum 41 passes through the primary transfer portion 44 by rotation of the photosensitive drum 41 (step S16), the controller 70 executes the ATVC (step S17). As a result, the ATVC can be always carried out in a state in which the carrier liquid is supplied to the primary transfer portion 44.

As described above, according to the image forming apparatus 1 in this embodiment, the controller 70 forms, during non-image-formation, the state in which the carrier liquid is supplied to the primary transfer portion 44. In this state, the controller 70 sets the transfer bias on the basis of a detection result of the voltage and current detecting circuit 82 when the setting bias is applied from the intermediary transfer drum 46. For this reason, the transfer bias can be set in a state in which the resistance value of the primary transfer portion 44 is equal to that during actual image formation, and therefore, a proper transfer bias can be set while using the liquid developer D.

Further, according to the image forming apparatus 1 in this embodiment, the controller 70 is capable of executing the ATVC by supplying the carrier liquid to the primary transfer portion 44 during main switch actuation of the main assembly of the image forming apparatus 1 or during pre-rotation of the image forming job, of during non-image-formation. That is, the controller 70 supplies the carrier liquid to the primary transfer portion 44 when the possibility of non-existence of the carrier liquid at the primary transfer portion 44 is particularly high, of during non-image-formation. For this reason, compared with during another non-image-formation in which a possibility of existence of the carrier liquid is high, the carrier liquid can be supplied without being wasted.

In the above-described image forming apparatus 1 in this embodiment, the case where only one kind of the target transfer current value $I_1$ stored in the ROM 72 was used was described, but the present invention is not limited thereto. For example, in the case where an optimum value of the primary transfer current varies depending on an environment temperature and humidity or a print mode, a target value of the primary transfer current corresponding to each of conditions may also be stored in the ROM 72 in the form of a table. In this case, depending on print setting or a temperature and a humidity detected by a temperature and humidity sensor in the image forming apparatus 1, reference to a corresponding portion in the table can be made. In this case, the image forming apparatus 1 is provided with an environment detecting portion 85 capable of detecting, as environment information, at least one of an ambient temperature and an ambient humidity, (FIG. 2). Then, the controller 70 sets the transfer bias on the basis of the ambient environment information of the primary transfer portion 44 detected by the environment detecting portion 85. As a result, depending on the environment information, it is possible to set a more proper transfer bias.

Further, in the image forming apparatus 1 in this embodiment, in the case where the controller 70 discriminated that the image forming job was during continuous image formation in the step S11, the carrier liquid has already been supplied to the primary transfer portion 44, and therefore the case where the ATVC was carried out as it is was described. However, the present invention is not limited thereto, but even in the case where the controller 70 discriminated that the image forming job was during continuous image formation, for example, the ATVC in this embodiment may also be executed every predetermined sheet (print) number. In this case, for example, even when the controller 70 effects control such that the developing roller 25 is spaced from the photosensitive drum 41 and the liquid developer is not supplied to the photosensitive drum 41 during a normal sheet interval, the developing roller 25 is prevented from being spaced from the photosensitive drum 41 even in the sheet interval for each predetermined sheet number. As a result, the carrier liquid is not supplied to the primary transfer portion 44 in the normal sheet interval, whereas even in the sheet interval the carrier liquid is supplied to the primary transfer portion 44 every predetermined sheet number, and therefore, the ATVC can be executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-112907 filed on Jun. 6, 2016, which is hereby incorporated by reference herein in its entirety.

What is claimed is:

1. An image forming apparatus comprising:

a photosensitive member;

a charging device configured to charge said photosensitive member;

an exposure device configured to expose a surface of said photosensitive member charged by said charging device to form an electrostatic latent image thereon;

a developing device, rotatably provided with a developer bearing member bearing a liquid developer containing toner and a carrier liquid, configured to develop the electrostatic latent image on the surface of said photosensitive member at a developing position with the toner by being applied with a developing bias;

a transfer member configured to transfer a toner image developed by said developing device on said photosensitive member at a transfer position by being applied with a transfer bias in a transfer period in which the toner image on said photosensitive member is transferred;

a transfer voltage source capable of applying the transfer bias to said transfer member in the transfer period;

a detecting unit configured to detect at least one of a voltage applied to said transfer member and a current flowing through said transfer member; and a controller configured to execute a setting mode in a predetermined period before execution of an image forming job after main switch actuation or during pre-rotation in the image forming job, the setting mode being a mode for setting the transfer bias to be applied to said transfer member in the transfer period based on a detection result of said detecting unit detected at a time when a test bias is applied to said transfer member from said transfer voltage source, wherein in the setting mode said controller is configured to cause said developing device to supply the carrier liquid to said photosensitive member and cause said transfer voltage source to apply the test bias when a region of said photosensitive member, which is substantially not formed with the electrostatic latent image for forming the toner image and is supplied with the carrier liquid with the developing bias being applied, is positioned at the transfer position.

2. The image forming apparatus according to claim 1, wherein said developer bearing member is provided to be contactable with and separable from said photosensitive member, and wherein in the setting mode said controller is configured to cause said developing device to apply the developing bias to said developer bearing member and control said developing device so that said developer bearing member is contacted to said photosensitive member after the developing bias is applied.

3. The image forming apparatus according to claim 2, wherein in the setting mode said controller is configured to cause said charging device to charge said photosensitive member and control said developing device so that said developer bearing member is contacted to said photosensitive member at a time when the surface of said photosensitive member which is charged is positioned at the developing position.

4. The image forming apparatus according to claim 3, wherein in the setting mode said controller is configured to cause said developer bearing member to rotate and control said developing device so that said developer bearing member is contacted to said photosensitive member while said developer bearing member rotates.

5. The image forming apparatus according to claim 1, wherein in the setting mode said controller is configured to cause said transfer voltage source to execute a constant-current control so as to flow a predetermined target current through said transfer member and to set the transfer bias to be applied to said transfer member in the transfer period based on a detection result of said detecting unit detected at a time while executing the constant-current control.

6. An image forming apparatus comprising:

a photosensitive member;

a charging device configured to charge said photosensitive member;

an exposure device configured to expose a surface of said photosensitive member charged by said charging device to form an electrostatic latent image thereon;

a developing device, rotatably provided with a developer bearing member bearing a liquid developer containing toner and a carrier liquid, configured to develop the electrostatic latent image on the surface of said photosensitive member at a developing position with the toner by being applied with a developing bias;

a transfer member configured to transfer a toner image developed by said developing device on said photosensitive member at a transfer position by being applied with a transfer bias in a transfer period in which the toner image on said photosensitive member is transferred;

a transfer voltage source capable of applying the transfer bias to said transfer member in the transfer period;

a detecting unit configured to detect at least one of a voltage applied to said transfer member and a current flowing through said transfer member; and a controller configured to execute a setting mode in a predetermined period before execution of an image forming job after main switch actuation or during pre-rotation in the image forming job, the setting mode being a mode for setting the transfer bias to be applied to said transfer member in the transfer period based on a detection result of said detecting unit detected at a time when a test bias is applied to said transfer member from said transfer voltage source, wherein in the setting mode said controller is configured to cause said developing device to supply the carrier liquid to said photosensitive member and cause said transfer voltage source to apply the test bias when a region of said photosensitive member, which is substantially not formed with the electrostatic latent image for forming the toner image and is supplied with the carrier liquid, is positioned at the transfer position.

* * * * *